US005443365A

United States Patent [19]

Ingling et al.

[11] Patent Number: 5,443,365

[45] Date of Patent: Aug. 22, 1995

[54] FAN BLADE FOR BLADE-OUT PROTECTION

[75] Inventors: Theodore R. Ingling, Loveland; Gary B. Manharth, Milford, both of Ohio

[73] Assignee: General Electric Company, Cincinnati, Ohio

[21] Appl. No.: 160,650

[22] Filed: Dec. 2, 1993

[51] Int. Cl.[6] ..... F01D 5/22; F01D 5/30

[52] U.S. Cl. ..... 416/193 A; 416/219 R; 416/238; 416/239; 416/248

[58] Field of Search ..... 415/9; 416/2, 193 A, 416/219 R, 220 R, 238, 239, 248

[56] References Cited

U.S. PATENT DOCUMENTS

| | | | |
|---|---|---|---|
| 2,605,996 | 8/1952 | Sturgess | 416/219 R |
| 3,834,831 | 9/1974 | Mitchell | 416/219 R |
| 3,902,820 | 9/1975 | Amos | 416/219 R |
| 4,047,840 | 9/1977 | Ravenhall et al. . | |
| 4,120,607 | 10/1978 | Coplin | 416/248 |
| 4,149,824 | 4/1979 | Adamson . | |
| 4,431,376 | 2/1984 | Lubenstein et al. . | |
| 4,453,890 | 6/1984 | Brantley . | |
| 4,534,698 | 8/1985 | Tomich . | |
| 4,580,946 | 4/1986 | Bobo . | |
| 4,643,647 | 2/1987 | Perry . | |
| 4,688,992 | 8/1987 | Kirkpatrick et al. . | |
| 4,743,166 | 5/1988 | Elston et al. . | |
| 4,820,127 | 4/1989 | Cohen et al. . | |
| 4,961,686 | 10/1990 | Blair et al. . | |
| 5,076,049 | 12/1991 | Von Benken et al. . | |
| 5,160,242 | 11/1992 | Brown | 416/193 A |
| 5,183,389 | 2/1993 | Gilchrist et al. | 416/193 A |
| 5,222,865 | 6/1993 | Corsmeier | 416/193 A |
| 5,271,718 | 12/1993 | Mitchell, Jr. et al. | 416/193 A |

FOREIGN PATENT DOCUMENTS

| | | | |
|---|---|---|---|
| 0008524 | 4/1969 | Japan | 416/220 R |
| 2008203 | 5/1979 | United Kingdom | 416/193 A |

*Primary Examiner*—Edward K. Look
*Assistant Examiner*—Christopher Verdier
*Attorney, Agent, or Firm*—Andrew C. Hess; Bernard E. Shay

[57] ABSTRACT

In a turbofan engine a fan designed for reduced damage during a blade-out condition wherein the fan blade airfoil is disposed asymmetrically on the platform and includes a forwardly displaced leading edge. The platform is configured to make early contact with a following airfoil upon blade-out.

15 Claims, 9 Drawing Sheets

FAN BLADE FOR BLADE-OUT PROTECTION

This invention relates generally to turbofan engine fans, compressors, and turbines and, more specifically, to a fan blade and fan blade system having improved resistance to damage during a blade-out condition.

BACKGROUND OF THE INVENTION

FAA certification requirements for a bladed turbofan engine specify that the engine demonstrate the ability to survive failure of a single fan blade at maximum permissible r.p.m., (hereinafter "blade-out condition"). Success requires containment of all high speed particles without catching fire and without failure of mounting attachments when operated for at least 15 seconds. The ideal design criteria is to limit blade loss to the single released blade. Impact loading on the containment casing and unbalanced loads transmitted to the engine structure are then at a minimum. If fan imbalance becomes too great loss of the entire fan or engine can result.

The fan radius ratio is defined as the radius of the hub, or inner wall boundary of the fan which is typically defined by the top of the fan blade platform at the airfoil leading edge, divided by the radius of the casing, or outer wall boundary of the fan which is typically defined by the blade containment at the airfoil tip leading edge. Prior fan blade design features were able to prevent secondary blade failures for engines having an inlet radius ratio (hereinafter "radius ratio") of 0.365, or larger. However, when these features were applied to an engine wherein the radius ratio was reduced to 0.33, failure of the trailing blade occurred upon impact with the released blade. Reducing the radius ratio, e.g. reducing the hub diameter and or increasing the casing diameter, resulted in a reduction in the number of fan blades from 38 in the 0.365 radius ratio engine to 34 in the 0.33 radius ratio engine due to limitations caused by the reduced circumference of the disc. The airfoil design required to achieve the necessary flow characteristics with less blades resulted in a wider chord blade and subsequently a 55 percent increase in blade weight. Significantly higher impact loads between the released blade platform and the trailing blade airfoil resulted in the loss of one half of the trailing blade on initial testing.

Increasing airfoil thickness to prevent secondary blade loss would have a significant impact on blade weight, disc sizing, radius ratio, and fan performance and is undesirable.

SUMMARY OF THE INVENTION

The invention comprises a turbofan fan blade including an airfoil portion attached at the airfoil root to a platform portion supported by a shank portion and configured such that the airfoil leading edge is displaced forward of the platform. Further, the platform leading side is proximate to both the airfoil leading edge and the airfoil trailing edge at the airfoil root to provide early contact between a released blade platform and an adjacent following blade airfoil. Further, the platform trailing side is structured to prevent bending and chamfered or curved for non-piercing contact with an adjacent airfoil.

BRIEF DESCRIPTION OF THE DRAWINGS

The novel features believed characteristic of the invention are set forth in the claims. The invention, in accordance with preferred embodiments, together with further objects and advantages thereof, is more particularly described in the following detailed description taken in conjunction with the accompanying drawing in which:

DETAILED DESCRIPTION OF THE PREFERRED EMBODIMENTS

Figure 1:
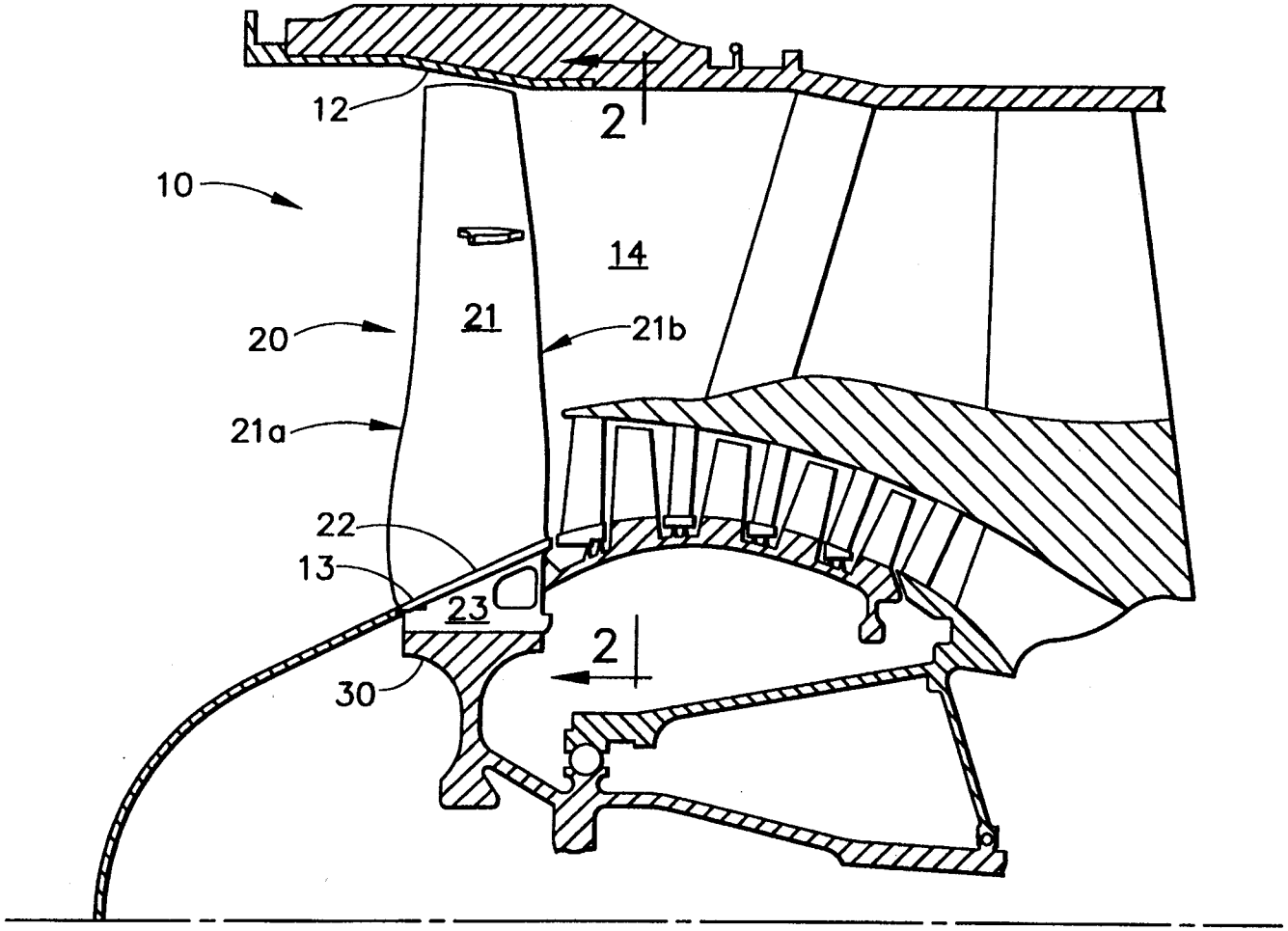
FIG. 1 is an illustration of a partly sectional view of the inlet region of a turbofan engine in accordance with the embodiment of the present invention.

FIG. 1 illustrates an inlet region 10 of an axial flow turbofan engine of the present invention including a fan blade 20 riding on a disc 30 and surrounded by blade containment 12. The entry area to the bypass airflow 14 is between the hub 13, or top of the platform 22, and the containment 12. The fan blade 20 includes an airfoil 21 with leading edge **12*a* and trailing edge 21*b* attached to a platform 22 which is attached to a shank 23 which in turn is attached to a dovetail 24 (see FIG. 3**).

Figure 2:
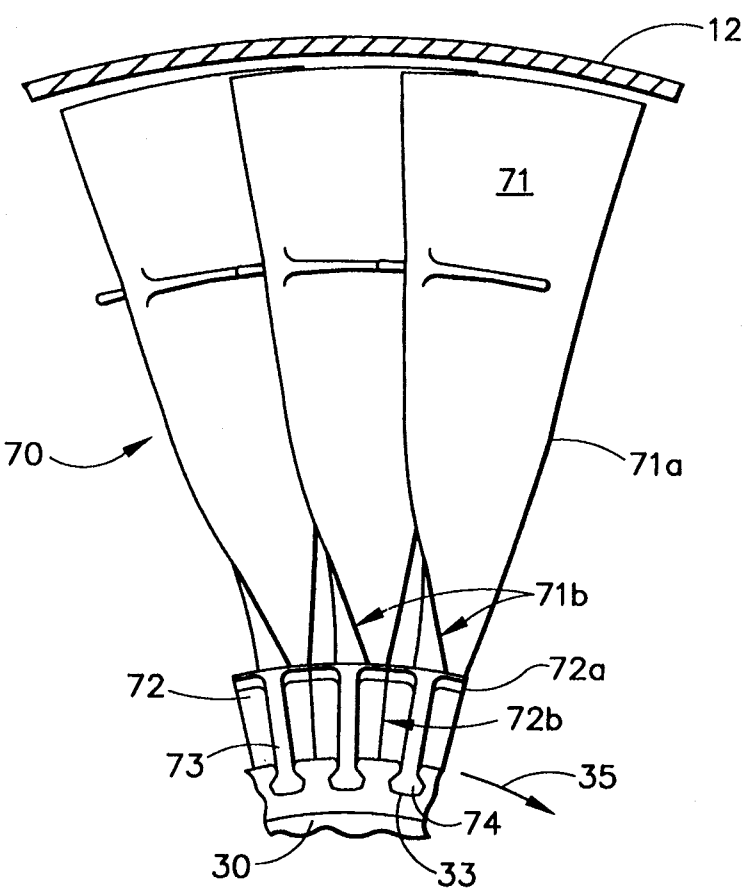
FIG. 2 (PRIOR ART)
FIG. 2 is an illustration of an aft looking forward view of three successive blades of a reduced radius ratio fan of prior an design.

Referring to FIG. 2, an aft looking forward view of three successive blades 70 of a 0.33 radius ratio fan, designed using prior art technology is illustrated. Fan rotation is indicated by arrow 35. A plurality of fan blades 70 are circumferentially distributed about the disc 30. The disc 30 contains a plurality of dovetail slots 33 configured for receiving the dovetail portions 74 of the plurality of fan blades 70. Platforms 72 include a leading side 72*a* and trailing side 72*b*. In this prior an design the platform 72 is generally symmetric with respect to the shank 73. This symmetric design causes the airfoil trailing edge 71*b* to be displaced some distance from the platform leading side 72*a*. As a result the airfoil trailing edge 71*b* is also displaced circumferentially from the platform trailing side 72*b* of an adjacent leading blade 70. This circumferential displacement, as explained below, causes excess damage during a blade-out condition.

Figure 3:
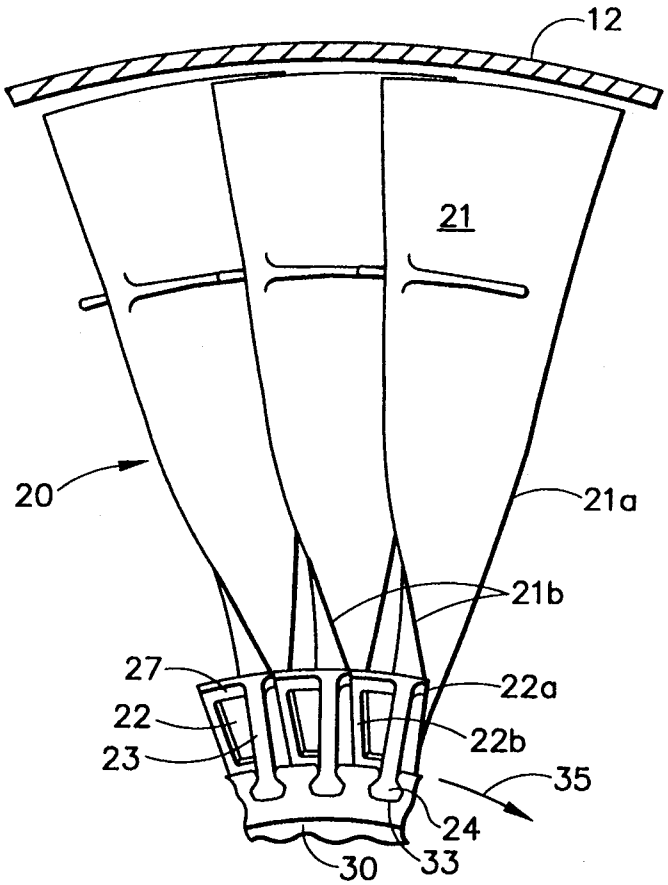
FIG. 3 is an illustration of an aft looking forward view of three successive blades of a reduced radius ratio fan in accordance with the present invention.
Figure 11:
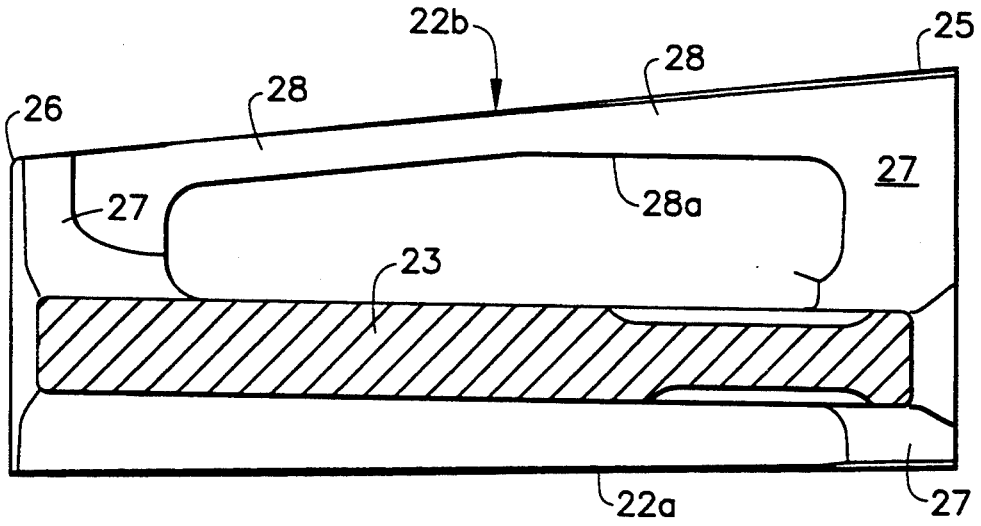
FIG. 11 is an illustration of a bottom view of the shank and platform illustrated in FIG. 10.

FIG. 3 illustrates an aft looking forward view of the 0.33 radius ratio fan of the present invention with fan rotation 35 indicated. Platform leading side 22*a* has been machined back and the platform trailing side 22*b* extended producing a design in which the platform is now asymmetric with respect to the shank 23 resulting in an airfoil trailing edge 21*b* in close proximity, preferably approximately $\frac{1}{8}''$, to the platform trailing side 22*b* of the adjacent leading blade 20. As best seen in FIG. 11 approximately $\frac{2}{3}$ of the platform 22 is located on the trailing side of the shank 23. The platform leading edge 22*a* is now generally parallel to a line tangent to both the airfoil leading edge 12*a* and the airfoil trailing edge 21*b* at the airfoil root 29 (hereinafter "root chord line" 36, shown in FIG. 5). Further, the platform leading side 22*a* is close, preferably within approximately $\frac{1}{8}''$, to the root chord line 36. This design allows a released blade 20 to make early contact with an adjacent following blade 20 as explained below.

Figure 5:
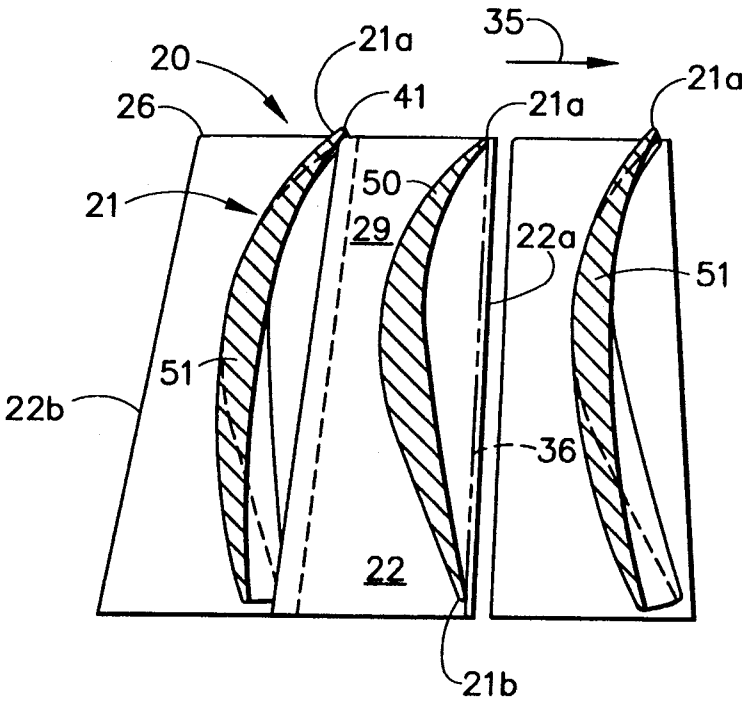
FIG. 5 is an illustration of a radially inward view of the blades illustrated in FIG. 4.
Figure 4:
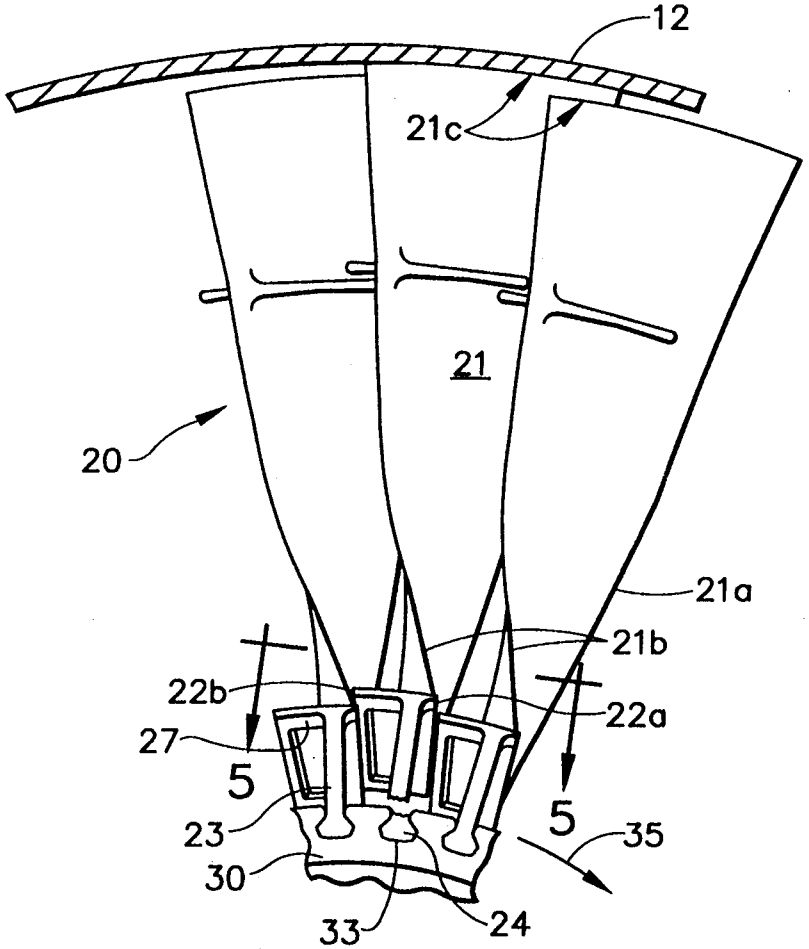
FIG. 4 is an illustration of an aft looking forward view of three successive blades during initial blade-out contact in accordance with the present invention.

FIG. 4 illustrates an aft looking forward view of the blade configuration of the present invention after release at the time of initial contact between the released blade 20 and the adjacent following blade 20 during blade-out testing. FIG. 5 shows a radially inward section view of FIG. 4. Arrows 35 indicate fan rotation. In FIG. 4 the shank 23 of the middle fan blade 20 has been separated from the dovetail 24 causing the remaining intact portions of the middle blade 20 to move outward from the disc 30. The airfoil tip 21*c* of the released blade 20 makes contact with the blade containment 12 resulting in the tips destruction.

FIG. 5 illustrates that once the middle blade 20 is released it is no longer rotationally driven and the adjacent following blade 20 begins to catch up with it. Initial contact between the released blade platform 22 and the adjacent following airfoil 21 occurs at point 41. Area 50 shows a cross-section of the airfoil 21 at the root. Root chord line 36 runs between the airfoil leading edge 12*a* and the airfoil trailing edge 21 b. The platform leading side 22*a* runs generally parallel to the root chord line 36 with the desired configuration being to place the platform leading side 22*a* close, preferably within approximately $\frac{1}{8}''$, to the root chord line 36 (also see FIG. 9). Areas 51 indicate cross-sections of the outer adjacent airfoils 21 at the radial height at which initial contact occurs. At this height the leading edge 21*a* of the unreleased airfoil 21 is displaced axially forward of the front face of the platform 22. Contact between a released blade platform 22 and an adjacent following airfoil 21 results in sheafing forces that act upon the airfoil 21. Displacing the airfoil 21 axially forward of the front face of the platform 22 reduces the likelihood that the shearing forces will cause the airfoil 21 to tear or break. Further, the forward corner 26 of the platform trailing side 22*b* is radiused to assist in moving the initial contact point 41 aft of a point where initial contact would occur for a non-radiused corner and to help prevent puncture and subsequent breaking of the airfoil 21. The released blade 20 continues to move radially outward in sliding contact with the airfoil 21.

Figure 7:
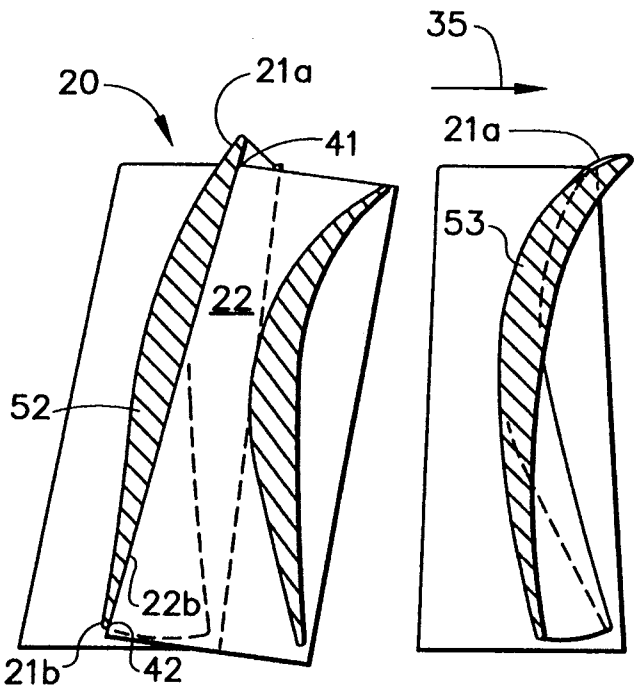
FIG. 7 is an illustration of a radially inward view of the blades illustrated in FIG. 6.
Figure 6:
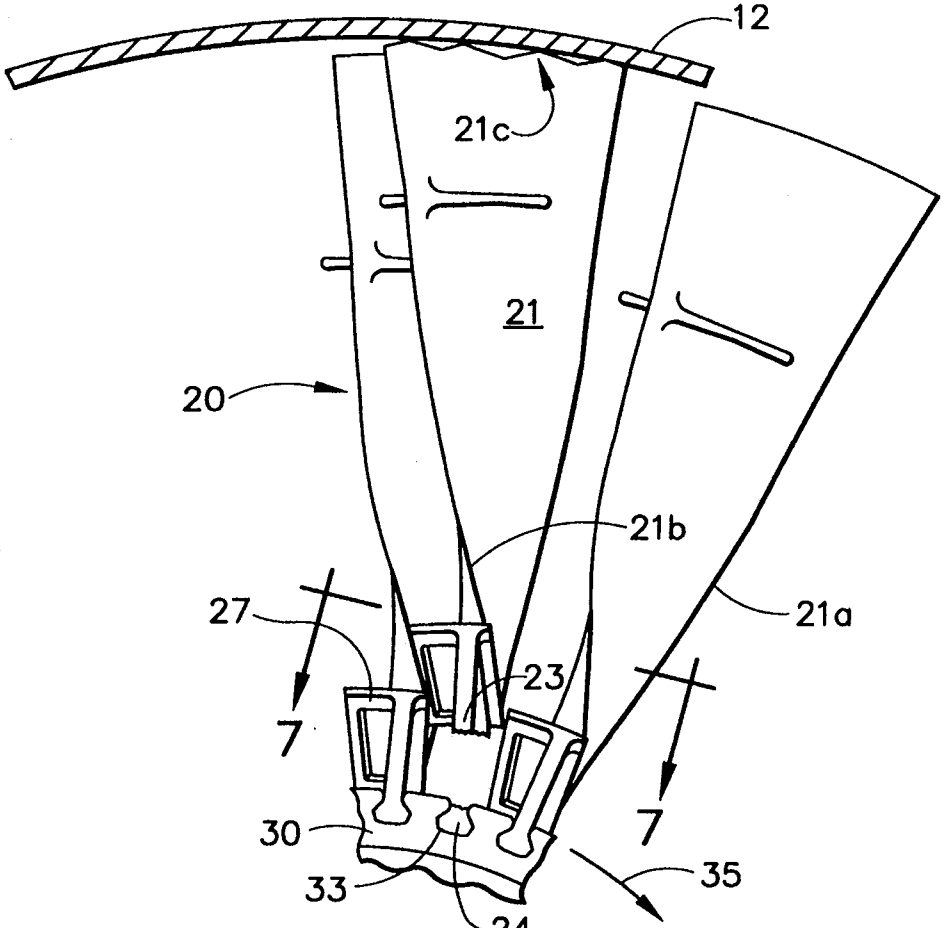
FIG. 6 is an illustration of an aft looking forward view of three successive blades during secondary blade-out contact in accordance with the present invention.

FIG. 6 illustrates an aft looking forward view of the blade configuration of the present invention just after the time of secondary blade-out contact with the following airfoil 21. FIG. 7 shows a radially inward view of FIG. 6. In FIG. 6 the released fan blade 20 has moved further radially outward from the disc 30 causing the destruction of the airfoil tip 21*c* as it contacts the blade containment 12 while remaining in sliding contact with the airfoil 21 at point 41 (see FIG. 7). At the same time the released blade 20 rotates about contact point 41 towards the adjacent following airfoil 21 until secondary contact is made. As shown in FIG. 7 the released blade platform 22 makes secondary contact at point 42 on the airfoil trailing edge 21*b* of unreleased blade 20. The loading force created by released blade platform 22 contact with the adjacent unreleased blade airfoil 21 at points 41 and 42 causes the unreleased airfoil 21 to quickly deform and straighten in the plane of the released blade platform 21 as shown by cross-section area 52. Area 53 on the leading airfoil 21 shows the normal cross-section of the airfoil 21 before straightening occurs. Once the contacted airfoil 21 straightens, the loading forces developed on the airfoil 21 are distributed essentially evenly along the airfoil and the released blade 20 begins to ride the airfoil 21. Forces developed on the released blade 20 cause the blade 20 to move aft while continuing to move radially outward until it is released into the bypass airflow region 14 shown in FIG. 1.

Figure 8:
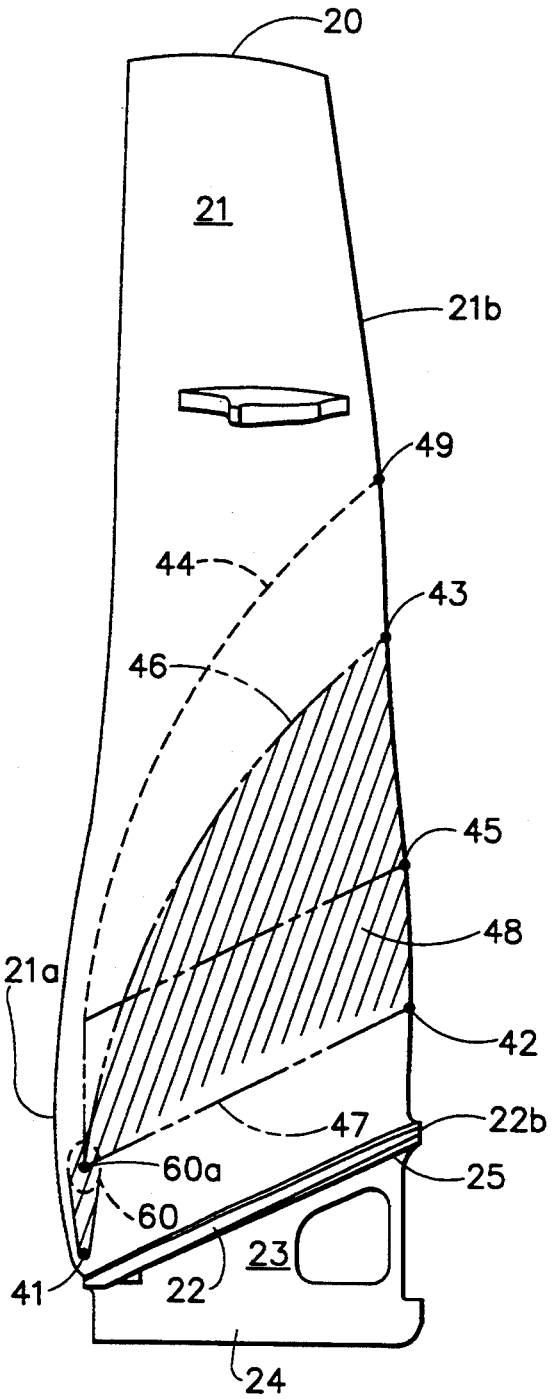
FIG. 8 is an illustration of a lateral view of a single fan blade in accordance with one embodiment of the present invention.

FIG. 8 illustrates a lateral view of a fan blade 20 on which the trajectories of a prior art and inventive blade are shown for comparison purposes. Note: the actual contact occurs on the concave side (pressure side) of the airfoil 21 which is not shown in this view. Point 41 indicates initial contact that a released blade platform 22 makes with the unreleased trailing airfoil 21 at leading edge 21*a*. Two paths for this leading edge contact are shown by the dashed line 44 and the dot-dashed line 46. Dashed line 44 indicates the trajectory of the leading edge contact for the prior art based 0.33 radius ratio fan shown in FIG. 2. Dot-dashed line 46 indicates the trajectory of the leading edge contact for the 0.33 radius ratio fan of the present invention. A blade-out condition for the fan of the present invention proceeds as follows. After initial contact the released blade 20 continues to move radially outward and loading upon the unreleased trailing airfoil 21 increases. When leading edge contact reaches the bottom of oval region 60 loading forces are large enough to cause the unreleased airfoil 21 to deform near the leading edge 21*a*. When secondary contact between the released blade platform 22 and the unreleased airfoil trailing edge 21*b* occurs at point 42, leading edge contact has moved to the center 60*a* of the oval region 60. After secondary contact, loading at point 60*a* begins to decrease and the unreleased airfoil 21 begins to straighten along the line 47 connecting the two contact points. Hatched areas 48 indicate contact between the released blade platform 22 and the unreleased airfoil 21. As the released blade 20 continues to move radially outward the unreleased airfoil 21 continues to straighten creating more contact area between the released blade platform 22 and the unreleased airfoil 21 and thereby distributing the effective load across more of the unreleased airfoil 21. As a result, the loading and deformation along the airfoil leading edge 12*a* are decreased. When leading edge contact reaches the top of oval region 60 the unreleased airfoil 21 has straightened completely and is in contact with the released blade platform 22 along the entire line running from leading edge contact to the airfoil trailing edge 21*b*. The released blade 20 continues to move radially outward and forces developed along the released blade platform 22 cause it to move axially aft as it rides the unreleased airfoil 21. The released blade 20 departs the unreleased airfoil 21 at point 43 into the bypass airflow region 14 shown in FIG. 1.

After a blade-out the leading edge contact point of the prior art 0.33 radius ratio fan follows the trajectory indicated by dashed line 44. Secondary impact does not occur until approximately point 45 meaning that blade deformation along the airfoil leading edge spans a much larger region increasing the possibility of a tear through the unreleased airfoil leading edge 21*a* resulting in undesired secondary blade loss. Further, because the secondary contact point 45 along the airfoil trailing edge 21*b* occurs radially higher, impact loading is too great and the airfoil 21 breaks resulting in secondary blade loss. Even if breakage does not occur upon secondary impact the released blade 20 rides higher out along the unreleased airfoil 21 and does not depart the unreleased airfoil 21 until point 49. This results in longer and greater loading and increased chance of secondary blade loss.

Thus, by allowing earlier contact between the released blade platform 22 and the unreleased airfoil 21, the blade design of the present invention prevents excess airfoil leading edge deformation, decreases secondary impact loading, and lowers the departure height of the released blade 20 which results in a lower kinetic energy of the released blade 20 and, therefore, allows for a containment system of reduced weight. The departure height of a released blade 20 in the fan of the present invention is less than ½ the height of the following unreleased airfoil 21.

Also shown in FIG. 8 is chamfered or curved (hereinafter chamfered) edge 25 on the trailing side 22*b* of the platform. This chamfered portion 25 is located on the trailing side 22*b* in those areas that initial contact with the airfoil 21 will occur for reducing contact stresses that can result in cutting of the airfoil 21 such as those that result when impact occurs with a sharp corner or edge of the released blade platform 22.

Figure 9:
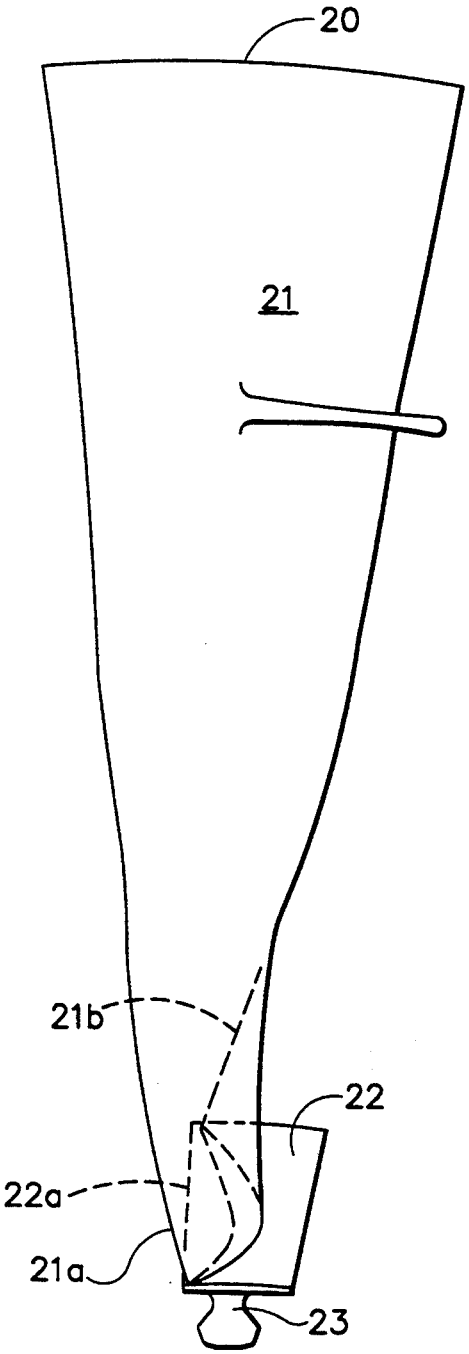
FIG. 9 is an illustration of a forward looking aft view of a single fan blade in accordance with the present invention.

FIG. 9 shows a fan blade 20 view from front looking aft. The asymmetric configuration of the platform 22 with respect to shank 23 and airfoil 21 is shown. The platform leading side 22*a* is configured such that it is proximate to, preferably within approximately ⅛", both the airfoil leading edge 12*a* and the airfoil trailing edge 21*b* at the airfoil root. Again, this asymmetric relationship between the airfoil 21 and the platform 22 allows the platform trailing side 22*b* of a released blade 20 to make early contact with the following airfoil 21 upon both initial and secondary contact.

Figure 10:
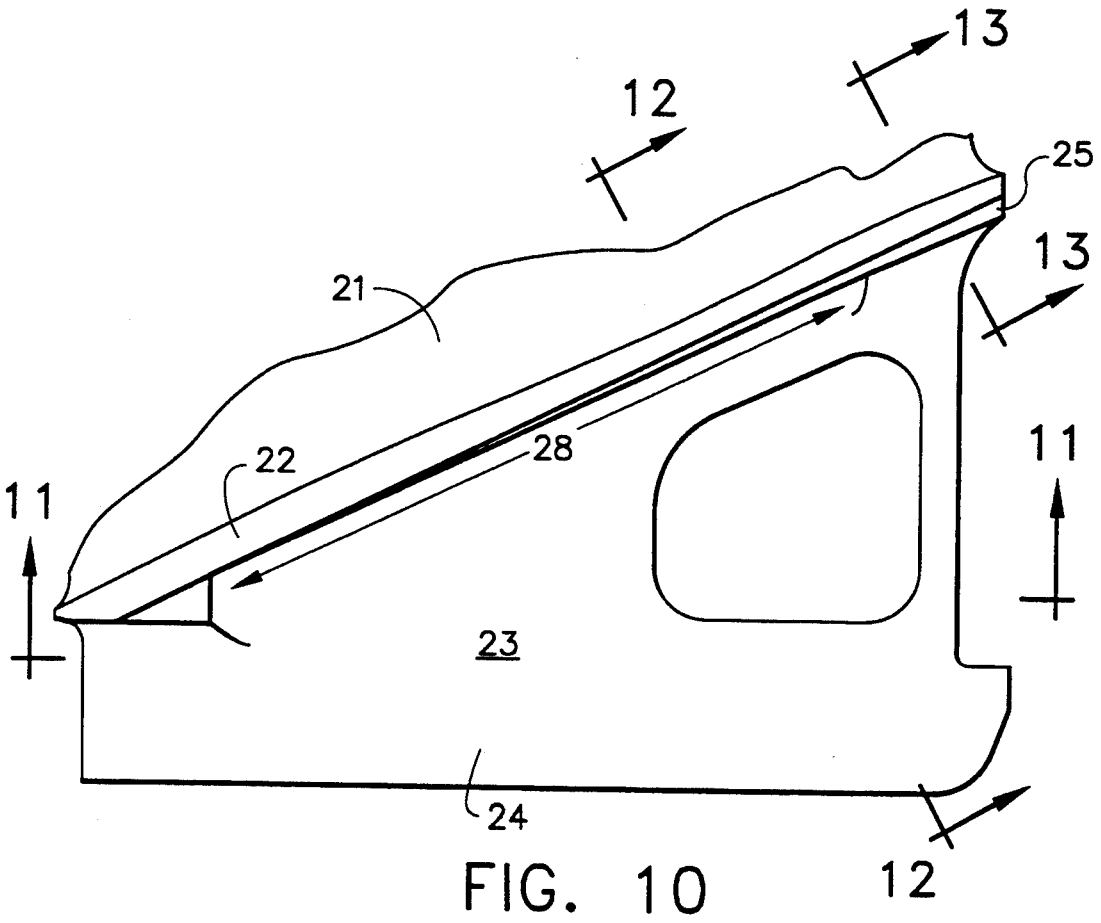
FIG. 10 is an illustration of a detailed lateral view of the blade platform, shank, and dovetail in accordance with one embodiment of the present invention.
Figure 12:
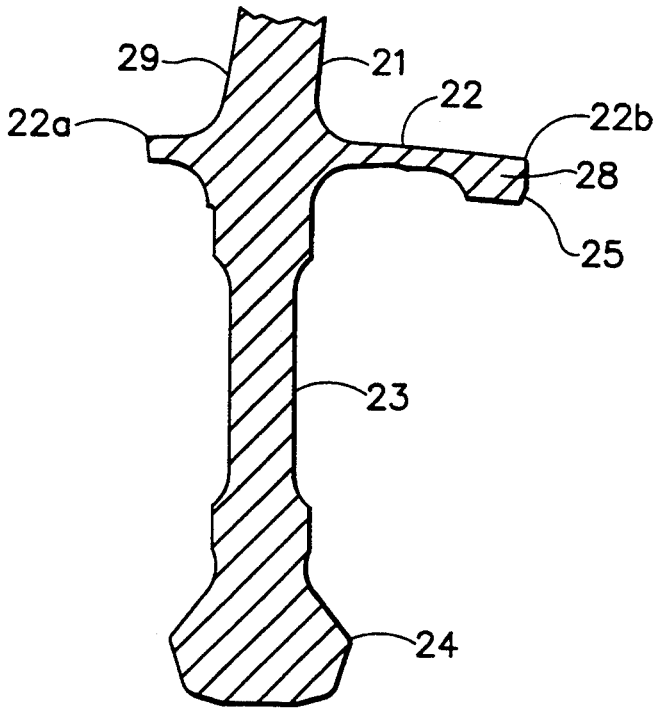
FIG. 12 is an illustration of an axially aft and radially outward section view of the platform, shank, and root illustrated in FIG. 10.
Figure 13:
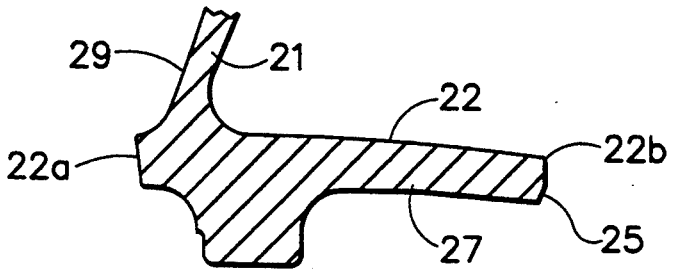
FIG. 13 is an illustration of an axially aft and radially outward section view of the aft portion of the platform illustrated in FIG. 10.

FIG. 10 is a side view of the blade platform 22, shank 23, and dovetail 24 of one embodiment of the present invention and is a reference for FIGS. 11–13. Chamfered edge 25 is also shown.

FIG. 11 is a bottom view of the partial fan blade 20 illustrated in FIG. 10, dovetail 24 cut-away for clarity. A structured rail comprising a built up rail 28 consisting of an additional thickness of metal runs between platform bumpers 27 along the platform trailing side 22*b* for preventing platform bending during contact with the following airfoil 21. Bending can cause uneven distribution of loading forces which can result in airfoil 21 puncture and can prevent the released blade 20 from being swept aft as desired. If the released blade 20 is not swept aft it will continue to move radially outward causing increased loading on the adjacent following airfoil 21. Built up rail 28 includes a taper 28*a* running approximately from mid-platform length to the aft bumper 27. Radiused corner 26 and chamfer 25 are also shown.

FIG. 12 illustrates a sectional view of the platform 22, shank 23, dovetail 24, and airfoil root 29 as indicated in FIG. 10. The chamfer 25 and built up rail 28 are illustrated. The built up rail 28 consists of an additional thickness of metal for added bending strength along the platform trailing side 22*b*. The typical prior art platform had a trailing side thickness of approximately 0.1". In this embodiment of the present invention the thickness of the platform trailing side 22*b* is increased to approximately 0.4" and is approximately 0.4" wide. Note that the built up rail 28 does not extend from the platform trailing side 22*b* entirely to the shank 23. The built up rail 28 is required only to improve bending resistance and additional width would result in an undesired increase in blade weight. The asymmetry of the platform 22 with respect to the shank 23 is also illustrated. The platform 22 width on the trailing side of the shank 23 is approximately 3 times as great as the platform 22 width on the leading side of the shank 23.

FIG. 13 shows a sectional view of FIG. 10 further aft along the platform 22. There is no longer a built up rail 28 depicted, the entire aft face of the platform is thick due to the platform bumper 27 and therefore no additional thickness is required for strength. However, chamfer 25 extends completely to the aft end of the platform 22. The proximity, approximately ⅛", of the airfoil 21 to the platform leading side 22*a* is also illustrated.

Figure 14:
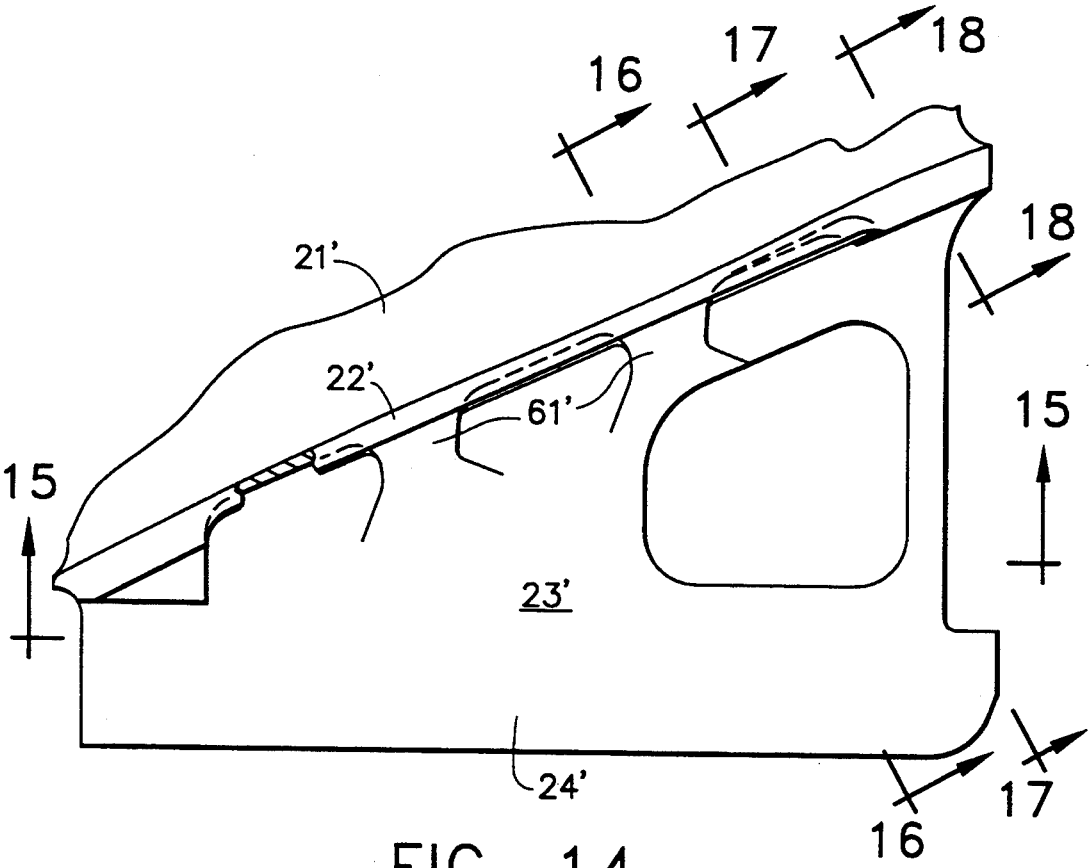
FIG. 14 is an illustration of a detailed lateral view of the platform, shank, and dovetail in accordance with one embodiment of the present invention.
Figure 15:
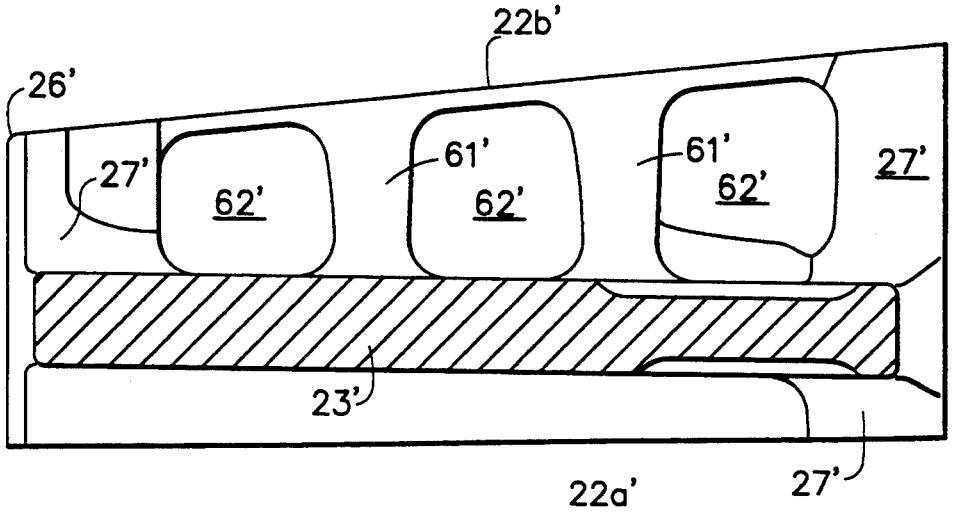
FIG. 15 is an illustration of a bottom view of the shank and platform illustrated in FIG. 14.

FIGS. 14 through 18 show an alternative embodiment of the platform 22' of the present invention. FIG. 14 is a side view of the blade platform 22', shank 23', dovetail 24', and airfoil 21' and is a reference for FIGS. 15 through 18. Referring to the bottom view shown in FIG. 15, dovetail 24' cut away for clarity, the built up rail 28 of FIG. 12 has been reduced and rib portions 61' have been added for increased bending strength. Areas 62' are undercut to decrease blade weight. Radiused corner 26' is still present.

Figure 16:
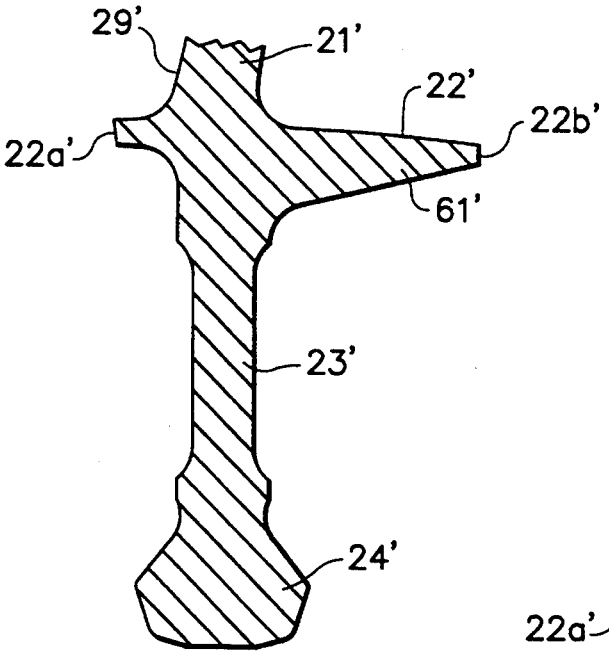
FIG. 16 is an illustration of an axially aft and radially outward section view of the platform, shank, and dovetail illustrated in FIG. 14.

FIG. 16 shows a sectional view of the platform 22', shank 23', and dovetail 24' as indicated in FIG. 14. Rib portion 61' tapers upon leaving the shank 23' until reaching the platform trailing edge 22*b'*. Rib tapering also helps to decrease blade weight.

Figure 17:
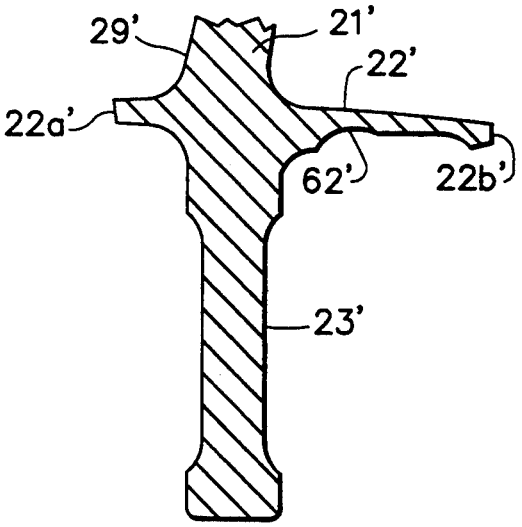
FIG. 17 is an illustration of an axially aft and radially outward section view of the platform and shank illustrated in FIG. 14.

FIG. 17 shows a sectional view of the platform 22' and shank 23' as indicated in FIG. 14. No rib portion 61' lies in this plane and therefore the platform is undercut 62' in a further attempt to decrease blade weight.

Figure 18:
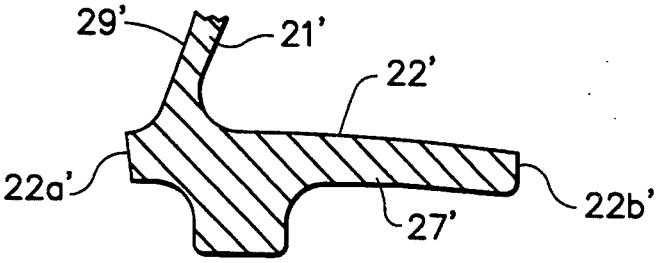
FIG. 18 is an illustration of an axially aft and radially outward section view of the aft portion of the platform illustrated in FIG. 14.

FIG. 18 shows a sectional view of the platform 22' as indicated in FIG. 14. Much like the previous platform embodiment shown in FIG. 13 the platform bumper 27' is shown along with the proximity of the airfoil 21' to the platform leading edge 22a'.

It will be clear to those skilled in the art that the present invention is not limited to the specific embodiments described and illustrated herein. Nor is it limited to fan blade technology. Rather, it applies equally to other bladed rows in a turbomachine such as compressors and turbine rows in which limiting blade loss is desired. Further, any dimensions given herein are exemplary only and it will be understood that changes therefrom can be made by those skilled in the art without departing from the invention as limited only by the spirit and scope of the appended claims.

What is desired to be secured by letters patent of the United States is the invention as recited in the following claims.

We claim:

1. A turbofan engine fan blade comprising:

an airfoil portion including a trailing edge and a leading edge;

a platform portion being asymmetrically attached to said airfoil and including a trailing side and a leading side; and said airfoil leading edge bowing forward in a region extending radially outward from said platform portion, said region including a primary location where a similarly configured leading blade would initially contact said airfoil during a blade-out condition of said leading blade, and a secondary location where said leading blade would have secondary contact with said airfoil during said blade-out condition, for reducing the possibility of failure of said airfoil.

2. The apparatus of claim 1 wherein said platform leading side is proximate to said airfoil trailing edge at a root.

3. The apparatus of claim 2 wherein said platform leading side is proximate to said airfoil leading edge at said root.

4. A turbofan engine fan blade comprising:

an airfoil portion including a trailing edge and a leading edge;

a platform portion being asymmetrically attached to said airfoil and including a trailing side, a leading side, and a root chord line extending between said leading edge and said trailing edge on said platform:

said platform leading side running generally parallel to said root chord line and configured within approximately ⅛ of an inch of said root chord line, such that failure of said airfoil upon contact between said airfoil and a similarly configured leading blade during a blade-out condition of said leading blade is prevented by reducing impulse loading on said airfoil.

5. The apparatus of claim 4 wherein said platform trailing side includes a structured rail for resisting bending during blade-out contact loading.

6. The apparatus of claim 5 wherein said platform trailing side includes a chamfer positioned for avoiding penetration of said airfoil upon secondary contact between said leading blade and said airfoil during said blade-out condition.

7. The apparatus of claim 6 wherein said airfoil leading edge bows forward in a region extending radially outward from said platform portion, said region including a primary location where said leading blade would initially contact said airfoil during said blade-out condition and a secondary location where said leading blade would have secondary contact with said airfoil during said blade-out condition, for reducing the possibility of failure of said airfoil.

8. The apparatus of claim 7, further comprising:

a shank portion;

said platform portion being asymmetrically attached to and supported by said shank portion; and said platform trailing side including a radiused forward corner for resisting puncture of said airfoil and establishing said primary location aft of a location contacted by a non-radiused corner.

9. The apparatus of claim 8 wherein said structured rail includes additional material along said platform trailing side having a thickness of 0.4 inches and a width of 0.4 inches.

10. The apparatus of claim 8 wherein said structured rail includes a rib portion attached to said shank portion and running to said platform trailing side.

11. In a turbofan engine a fan blade system comprising:

a blade retaining member having a plurality of dovetail slots for matingly engaging a plurality of fan blades, each of said fan blades comprising a dovetail portion, a shank portion, a platform portion, an airfoil portion;

said dovetail portion engaging a mating blade retaining dovetail slot;

said shank portion attaching to said dovetail portion;

said platform portion being asymmetrically attached to and supported by said shank portion and including a trailing side and a leading side;

said airfoil portion being asymmetrically attached to said platform portion and including a trailing edge, a leading edge, and a root chord line extending between said leading edge and said trailing edge on said platform;

said airfoil leading edge bowing forward in a region extending radially outward from said platform portion, said region including a primary location where a similarly configured leading blade would initially contact said airfoil during a blade-out condition of said leading blade, and a secondary location where said leading blade would have secondary contact with said airfoil during said blade-out condition, for reducing the possibility of failure of said airfoil;

said platform leading side running generally parallel to said airfoil root chord line and configured within approximately ⅛ of an inch of said airfoil root chord line, such that failure of said airfoil upon contact between said airfoil and said leading blade during said bade out condition is prevented by reducing impulse loading upon said airfoil; and said platform trailing side including a structured rail to resist platform bending during contact loading, a chamfer positioned for avoiding penetration of said airfoil upon secondary contact between said leading blade and said airfoil during said blade-out condition, and a radiused forward corner for resisting puncture of said airfoil and establishing said primary location aft of a location contacted by a non-radiused corner.

12. The system of claim 11 wherein said structured rail includes additional material along said platform trailing side having a thickness of 0.4 inches and a width of 0.4 inches.

13. The system of claim 11 wherein said structured rail includes a rib portion attached to said shank portion and running to said platform trailing side.

14. The system of claim 11 wherein said released blade departs said airfoil at a height less than ½ the height of said airfoil for reducing a Kinetic energy of said leading blade upon departure.

15. The system of claim 14 wherein said reduced Kinetic energy of said leading blade allows for a smaller containment system for reducing a weight of said engine.

* * * * *